United States Patent [19]

Amalaha

[11] Patent Number: 4,817,165

[45] Date of Patent: Mar. 28, 1989

[54] ACOUSTIC SPEAKER DEVICE WITH A DIAPHRAGM HAVING A SPIDER WEB TYPE CORE

[76] Inventor: Leonard D. Amalaha, 6202 44th Ave., Riverdale, Md. 20737

[21] Appl. No.: 4,149

[22] Filed: Jan. 27, 1987

[51] Int. Cl.[4] ..... H04R 9/04

[52] U.S. Cl. ..... 381/202; 381/158; 381/177; 381/192; 381/199; 181/170; 181/173

[58] Field of Search ..... 381/158, 168, 177, 192–194, 381/197, 199–204; 181/157, 170, 173, 174, 166

[56] References Cited

U.S. PATENT DOCUMENTS

| | | | |
|---|---|---|---|
| 4,003,449 | 1/1977 | Bertagni | 381/202 |
| 4,198,550 | 4/1980 | Matsuda et al. | 381/202 |
| 4,300,655 | 11/1981 | Sakamoto et al. | 381/202 |
| 4,311,881 | 1/1982 | Reynard | 381/202 |
| 4,322,583 | 3/1982 | Maeda | 381/202 |
| 4,472,604 | 9/1984 | Nakamura et al. | 381/203 |

FOREIGN PATENT DOCUMENTS

| | | | |
|---|---|---|---|
| 0138196 | 8/1983 | Japan | 381/203 |
| 0013499 | 1/1984 | Japan | 181/173 |
| 0190797 | 10/1984 | Japan | 181/173 |

*Primary Examiner*—John W. Caldwell, Sr.
*Assistant Examiner*—Tyrone Queen
*Attorney, Agent, or Firm*—Richard C. Litman

[57] ABSTRACT

A dome-shaped acoustic motor diaphragm having a core of aluminum foil in the form of a spider web configuration resulting in the dome shape, the diaphragm being in the form of an annular semi-dome outer diaphragm part and a dome-shaped cylindrical inner diaphragm part. The spider web core also enables a wide variety of diaphragm shapes to be possible. A voice coil bobbin is passed through a lower diaphragm layer and unto the underside of an upper diaphram layer via the core which more or less is the greatest height of the same core in the region of the outer diaphragm part, thereby resulting in a highly effective bonding strength between these parts. Damping is accomplished by means of a cylindrical bellows having a height representing the maximum excursion distance of the movable parts. A bobbin guide positioned within the bobbin and bonded to the inner face of the lower magnetic pole piece prevents the bobbin and voice coil in the annular air gap from contacting the pole pieces.

6 Claims, 10 Drawing Sheets

FIG.5
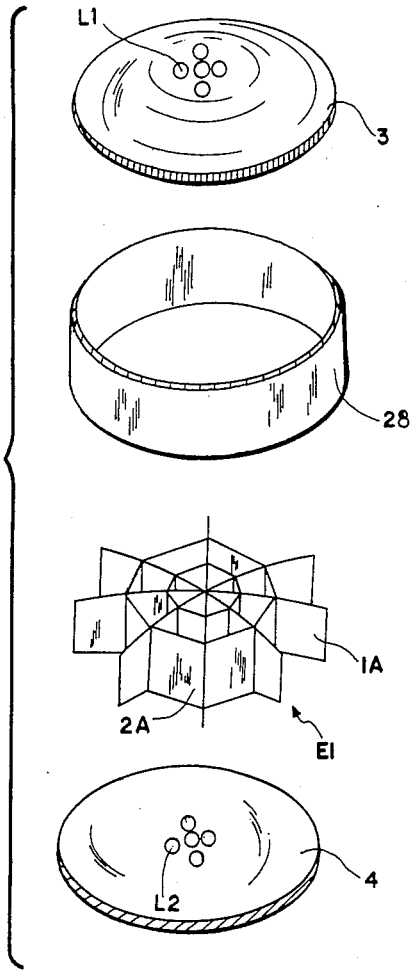
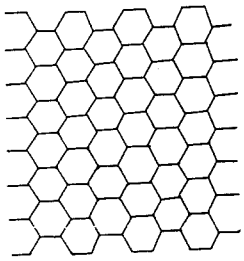
FIG. 6 PRIOR ART
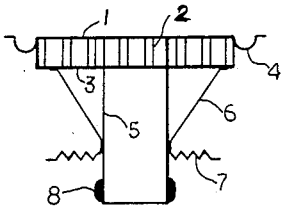
FIG. 7 PRIOR ART
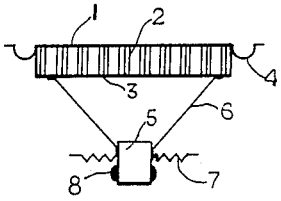
FIG. 8 PRIOR ART
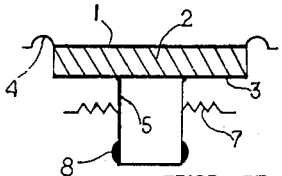
FIG. 9 PRIOR ART
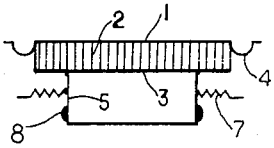
FIG. 10 PRIOR ART
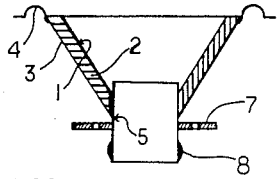
FIG. 11 PRIOR ART

STEP I

STEP II

STEP III

STEP IV

STEP V

STEP VI

STEP VII

STEP VIII

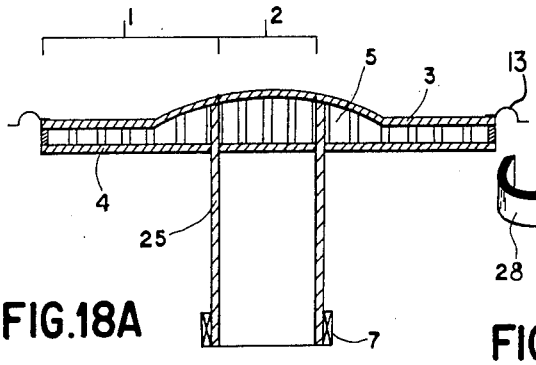
FIG.18A
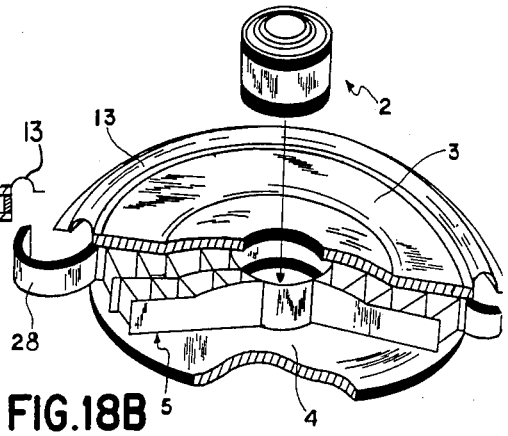
FIG.18B
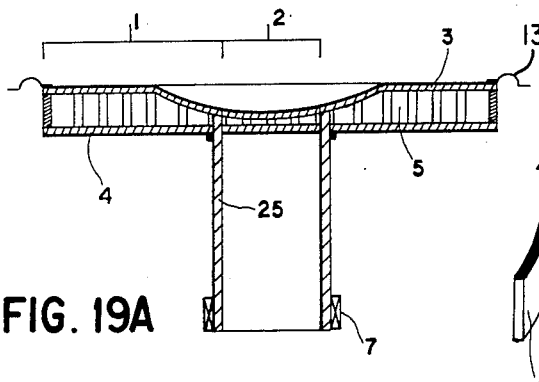
FIG. 19A
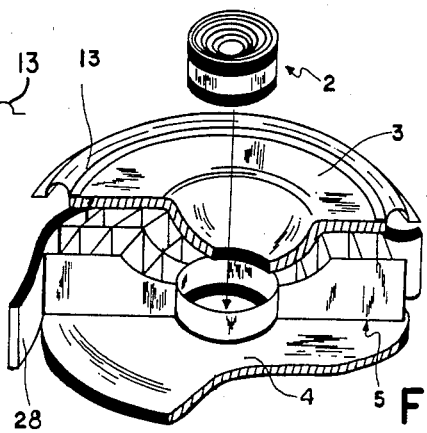
FIG.19B
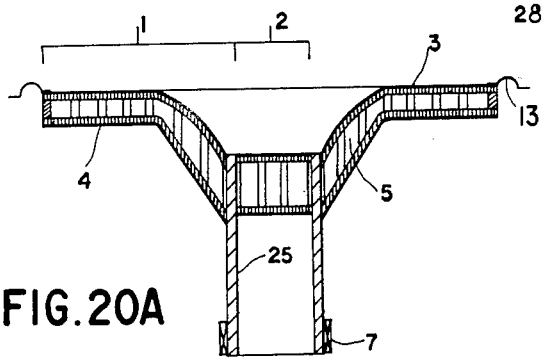
FIG.20A
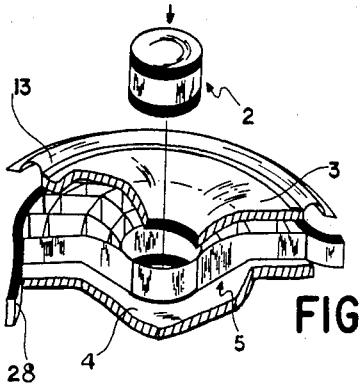
FIG.20B
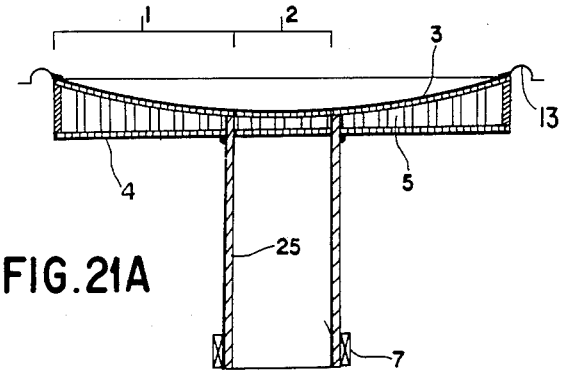
FIG.21A
FIG. 21B
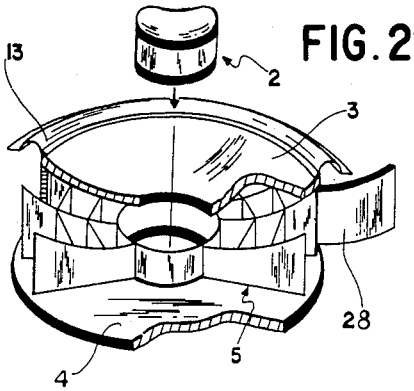

ACOUSTIC SPEAKER DEVICE WITH A DIAPHRAGM HAVING A SPIDER WEB TYPE CORE

BACKGROUND

1. Field of the Invention

This present invention refers to a diaphragm core of aluminum in the form of a spider web structure used to obtain a wide variety of diaphragm shapes including a flat, concave, convex (dome), cone, combination flat/-concave, combination flat/convex and combination flat/cone. However, it more particularly applies to a dome shaped loudspeaker diaphragm employing this present core to obtain said shape.

2. Prior Art

There exists, conventional planar type loudspeakers which embody a diaphragm core of honey comb structure made of aluminium foil. This design results in high strength and lightness as well as being able to surpress lower degree modes or partial vibrations so as to broaden the higher frequencies or eliminate peak dip frequency anomaly that occurs in cone shaped diaphragms. However, in these planar type conventional loudspeakers, partial vibration modes do occur contrary to repeated claims. This is due in part to weak regions of the core structure usually the trimmed edge portions. Also, mechanical distortions could arise due to a large diaphragm having a relatively large bobbin diameter hence a large coil, which cuts down on speed while generating said distortions. In some designs that employ a short bobbin with a spider attached in its middle, the maximum excursion distance could be drastically reduced due to early bottoming. Also, in trying to eliminate resonance and increase the diaphragm strength, some designs have attached to the diaphragm behind it, a support rib whose lower section is attached to the bobbin. This said support rib depending on material strength, weight and size could altogether be undesirable. Again in some conventional types of planar loudspeakers having the known honey comb structure in question, there is a tendency for the bobbin to come off its attachment with extended use due to the inadequate means of bonding the surfaces together with the bonding agent. However, the known planar type electro-acoustic transducer, U.S. Pat. No. 4,472,604 Sept. 18, 1984, Japan Pat. No. 0143625 11/79 Nakamura et. al. has an effective bonding technique which is also used in this present invention. However, it will be appreciated, the fact that due to the dome shape of this present invention a higher structural strength between the surfaces is obtained with this present invention for drivers of comparable size having the same maximum core height. Of course this is due to a lesser total diaphragm mass resulting from design. (See FIG. 15). Also, owing to the flat nature of their diaphragms resulting from the honey comb core, known planar type loudspeakers fail to achieve a great angle of dispersion of the radiated waves in relation to the degree or size of excursions. Again, in designs employing a coreless flat diaphragm made of fabric with an impregnated kitt, accurate pistonic motion is jeopardized. Conventional loudspeakers of the planar type affected by one or more of the aforementioned shortcomings include U.S. Pat. Nos. 4,322,583 3/82 Maeda, 4,122,314 10/78 Matsuda et al, 4,472,604 11/79 Nakamura et al, 3,937,905 Feb. 10, 1976, Germany Pat. No. 2236374 July 24, 1973 Manger.

SUMMARY

It is the object of this present invention to completely resolve the said shortcomings of the prior art by design. A complete rendering of the invention is in accordance with the drawing in FIG. 1. It has a movable unit A, comprised of a diaphragm having a core, bobbin/voice coil, bellows and a flexible surround; a chassis B having a main frame and a subframe; the subframe having an annular suspension plate. There is a magnetic arrangement C having a magnet and pole pieces; a bobbin guide unit D comprised of a plastic base, resilient material (damper) and an outer skin member.

BRIEF DESCRIPTION OF THE DRAWINGS

FIG. 5 is an exploded view of the inner diaphragm part showing the inner core region, the core skin and the diaphragm layers.

FIG. 6 is an aerial view of a conventional honeycomb structure employed in known planar type loudspeakers.

FIGS. 7 thru 10 represent diagrammatic vertical views, sectionally, of other known diaphragms of the planar type for loudspeakers employing the core shown in FIG. 6.

FIG. 11 is a diagrammatic vertical view, sectionally, of another known diaphragm for a loudspeaker in the form of a frusto-conical configuration and employing the core shown in FIG. 6.

FIG. 18A thru 21A represent diagrammatic vertical views,sectionally, of diaphragms for a loudspeaker employing the cores shown in FIGS. 2 and 5 which are in accordance with this present invention.

FIGS. 18B thru 21B represent cutaway diagrams showing same diaphragms and embodiments of 18A thru 21A but excluding the bobbin and having the inner diaphragm parts lifted. FIGS. 18 thru 21 are concurrent with the teachings of this present invention.

OBJECT/DETAILED DESCRIPTION

Figure 1:
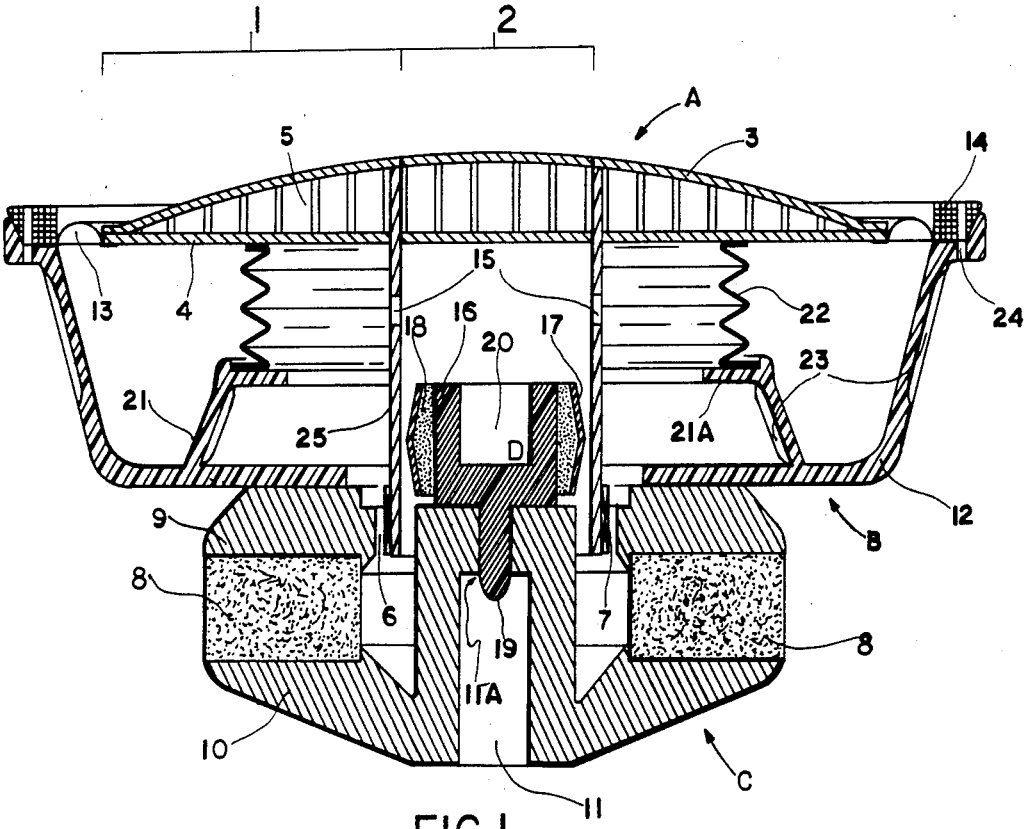
FIG. 1 is a cross-sectional view of a complete redering of an acoustic motor in accordance with this present invention.

It is the object of this present invention to completely resolve the said shortcomings of the prior art by design. A complete rendering of the present invention is in accordance with the drawing in FIG. 1. It has as aforementioned in the summary, a movable unit A comprised of a diaphragm having a core, bobbin/voice coil, bellows and a flexible surround; a chassis B having a main frame and a subframe; the subframe of which has an annular suspension plate. There is a magnetic arrangement C having a magnet and pole pieces; and a bobbin guide unit D comprised of a plastic base, resilient material and an outer skin member. As depicted in FIG. 1 an acoustic motor designed according to the present invention eliminates the need for a support cone or rib because the diaphragm is supported about the regions of possible resonance modes by a cylindrical bellows 22 thereby eliminating the subsequent resonance modes which occur in some conventional planar loudspeaker diaphragms due to the trimmed exposed edge portions of the core. This correction is hereby made possible by upper 3 and lower 4 diaphragm layers converging at a point and totally encasing the core 5 and preventing there to be, the said exposed core peripheral edge portions; or the need for a strip-like edging member. However, it is emphasized that for diaphragm designs employing this present core 5 and having a height at the peripheral edge, an edging strip could be employed. (See FIGS. 18 thru 21). Also, a spider (damper) and/or a support cone could be employed in these designs if desired.

The bellows 22 of this present invention (damper) could be manufactured with plastic materials by molding or with fabrics. However, other light and strong materials could also be explored. The upper open end edge of the bellows 22 is attached to the lower diaphragm layer 4 while its lower open end edge is attached to the annular suspension plate 21A of the subframe 21 which is part of the main frame 12. The bellows 22 are made in such a way that the segments are almost inelastic in bending but quite elastic in their plane. One advantage of the bellows 22 over the spider is that it enables all the moving parts to travel along a plane whose degree of accuracy surmounts that of a system employing the spider suspension. Both the spider and the bellows 22 center the voice coil 7 and permit minimal resistance to axial motion but the spider doesn't support the diaphragm A. Also, since the bellows 22 is not coupled to the bobbin 25 as with the spider, there is eliminated for the first time the tendency for the damper to come off its attachment with extended use.

The bellows 22 is best located at an equal distance between the bobbin 25 and the outer edge of the diaphragm A to effectively perform the dual role of supporting the diaphragm A while centering the voice coil 7 in the air gap 6. The closer the bellows 22 (damper) to the bobbin 25, the greater its ability to center the coil/-bobbin in the air gap 6, but lesser its ability to support the diaphragm A at the sites of susceptible second degree modes or unwanted vibrations (usually the outer regions) and vice versa. It therefore is one object of this invention to bring to light through the above understandings, the fact that for a true accurate pistonic motion of a diaphragm to be effected, there must not be any form of attachment to the lower sections of the bobbin 25 as with the spider. Freeing the bobbin 25 in the said manner permits the voice coil 7 to be as sensitive as it can be while ensuring that its ocillations are communicated to all the moving parts at virtually the same time without any noticeable lag in coupling.

Quite unlike conventional planar type loudspeakers, this present acoustic motor employs an aforesaid dome shaped diaphragm A comprised of a dome shaped upper diaphragm layer 3 and a disk like lower diaphragm layer 4 having sandwiched between them a core 5 of aluminum foil of spider web configuration. This said core 5, obtained easily by molding has lightness and high structural strength. The resulting diaphragm A has an annular semi-dome shaped outer diaphragm part 1 and a dome shaped cylindrical inner diaphragm part 2 resulting in an increased angle of dispersion of the radiated waves.

This present diaphragm core 5 designated the spider web core (SWC) configuration is comprised of an outer core region having lateral ribs originating from a central tubular rib representing the diameter of the voice coil bobbing. The shape of the lateral ribs determine the shape of the resulting diaphragm. Sandwiched between the lateral ribs are the orbital ribs having solid angles to the lateral ribs and assuming the height of the lateral ribs at the points of attachment. Also, the orbital ribs have equal distances between them and as the name suggests, are of circle-like (polygonal) arrangements around the central tubular rib extending towards the outer perimeter regions of the diaphragm core. If desired, short length lateral riblets could be employed to further enhance the rigidity of the core at the peripheral regions as the distance between a pair of lateral ribs increase towards the outer perimeter. There is an inner core region of same arrangement with the outer region but lacking a central tubular rib. In other words the lateral ribs originate from a point. This said inner core region has a tubular peripheral edge skin member assuming the inner diameter of the bobbin. The lateral ribs of both core regions are aligned to further enhance rigidity. Markings could be used to determine the exact locations of the lateral ribs in both core regions for the purpose of alignment. However, in a situation of complete saturation of the central tubular rib by the lateral ribs, alignment may not be necessary. The upper 3 and lower 4 diaphragm layers of the inner diaphragm part 2 have several small openings at their center to help cool down the voice coil 7 as well as equalization of pressure within the bobbin 25 and the exterior. The openings of the upper diaphragm layer 3 of the inner diaphragm part 2 are covered with a plug of thin clothing (air permeable) material to trap dust.

The bobbin 25 is passed through the lower diaphragm layers 4 to the underside of the upper diaphragm layer 3 of the outer diaphragm part 1 in the core 5 which more or less is the greatest height of same forming the annular outer core region; thereby resulting in a very effective bonding strength of these parts with a bonding agent. The equalization of pressure within the chamber created by the outer wall of bobbin 25 and the inner wall of the bellows 22 is through the openings 23 on the subframe 21 and main frame 12. There are perforations 15 on the upper part of the bobbin 25 to further enhance atmospheric pressure equalization. The voice coil 7 and bobbin 25 are properly centered in the annular air gap 6 of the magnetic field generated by the magnet 8 having pole pieces resulting in the said air gap 6. Uniformity of the air gap 6 is achieved by the design of the pole pieces 9 and 10.

The upper pole piece 9 of the magnet 8 has a recess whose height is aligned with that of the part of the lower pole piece 10 in the air gap 6. Both pole pieces have stops that assume the inner diameter of the magnet 8 by slightly extending past the upper and lower inner edges of the magnet 8. The lower pole piece 10 has two holes thru it for the purpose of concentrating magnetic field in the air gap as well as aiding the positioning of a centering jig or the bobbin guide unit D.

The holding jig which has a hollow cylinder and a pin-like lower end which fits into the smaller hole on the lower pole piece could be made of plastic materials. It has an outer wall practically assuming the internal diameter of the bobbin 25. The jig's inner diameter at its lower end is set to assume the outer diameter of the part of the lower pole piece 10 of the magnet 8 in the air gap 6. During the centering of the voice coil 7 and bobbin 25 in the air gap 6, the holding jig is positioned in the said smaller hole 11A on the magnet's lower pole piece 10; the moving parts except the inner diaphragm part 2 and gasket 14 bonded together with a bonding agent are attached to the frame 12 by passing the bobbin 25 through the jig. An air tight seal between the diaphragm's outer edge and the frame is achieved by means of a flexible surround 13 and a gasket 14.

There is a bobbin guide unit D as aforementioned, positioned within the bobbin 25 and bonded to the inner face of the magnet's lower pole piece 10 in the air gap 6 to prevent the bobbin 25 from contacting the pole pieces 9 and 10 during excursions as well as permitting a more accurate pistonic motion of the moving parts. It comprises of a rigid plastic base 16 with an opening 20 at its upper part to fit a push rod and a pin-like lower part 19 fitting into the smaller hole 11A on the part of the lower magnetic pole piece 10 in the air gap 6. Sandwiched between an outer bulged side skin member 17 is a plug of resilient material 18 (preferably foam or rubber) of adequate resilience to permit a slight damping action. The skin member 17 could be made easily with plastic or aluminum. The plug of resilient material 18 is of the same height and shape with the sking member 17 but had larger diameters before insertion,-which shrunk to assume those of the skin member 17 by being forced into it. The resilient material 18 and skin member 17 have a clearance from the face of the pole piece 10 within the bobbin 25. The resilient material 18 is bonded to the plastic base 16 by means of a bonding agent to complete the unit. The skin member 17 and the inner face of the bobbin 25 could be coated with graphite or teflon to reduce any possible friction between the surfaces. The outer diameter of the skin member 17 at the maximum point of bulge is set to be much greater than the outer diameter of the portion of the lower magnetic pole piece 10 in the air gap 6 but only slightly smaller than the inner diameter of the bobbin 25. If a rolling resistance is applied in the BGU (e.g. rollers), permanent contact between the bobbin and BGU will be possible. The height of the bobbin guide D is set flush with the suspension plate 21A of the subframe 21 which is about the maximum possible excursion distance. During large excursions, instantaneous contacts could be made between the bobbin 25 and the outer skin member 17 of the bobbin guide unit (BGU) D. When this occurs, thanks to the BGU, clearances would be left between the bobbin 25 and pole pieces 9 and 10 within the air gap 6 so that no contact is made between these parts. Quite unlike contacts between the bobbin 25 and the pole pieces 9 and 10, the damping effect of the BGU's resilient material 18 and the low friction of the contacting surfaces, ensure there will not be effected, a degradation of the radiated waves during travels or excursions. Even when impacts between the bobbin 25 and skin member 17 of the BGU D are strong enough to noticeably deform the resilient material 18 at a site of contact (e.g. NW, SW, etc.), the pole pieces should be uncontacted.

In place of the (BGU), rolling resistance in the form of small pinch or ball rollers (preferably of a non magnetic material) could be employed. The pinch rollers have an outer skin of rubber and supports attached to the lower part of the main frame and bonded thereto. See FIG. 22. Since the pinch rollers can only safely be applied outside the bobbin by barely touching it, observance of polarity is necessary to prevent the voice coil from contacting the rollers during large excursions. The rollers are best located at a distance from the voice coil (at rest), representing the maximum excursion distance in an upward direction. Centering of the voice coil in the air gap using the jig must be completed before the pinch rollers are positioned for the purpose of accuracy. The rollers permit minimal resistance to axial motion while ensuring an accurate location of the coil and bobbin in the air gap at all times. From the pinch roller (PR) and ball roller (BR) FIG. 23 concepts, it is understood that for a voice coil/bobbin to be correctly located within an extremely narrow air gap during large excursions without contacting the pole pieces, the means of centering the voice coil/bobbin in the air gap must remain rigid during travels, quite unlike the Spider which is virtually a 'diaphragm' behind the diaphragm.

It is believed that individual detailed description of the drawings will further enhance understanding of this devicce. In reference to FIG. 1, A represents the movable unit, B the chassis, C the magnetic arrangement and D the bobbin guide unit. At 1 is the outer diaphragm part in the form of an annular semi dome. At 2 is the inner diaphragm part in the form of a dome shaped cylinder. At 3 and 4 are the upper and lower diaphragm layers respectively having the core 5 sandwiched between them. At 6 is the annular air gap of the magnetic field generated by the magnet 8 having pole pieces 9 and 10. At 7 is the moving coil attached to the bobbin 25 and positioned in the air gap 6. At 8 is the magnet generating said magnetic field in the air gap 6 by means of the pole pieces 9 and 10. At 9 is the aforementioned upper pole piece of the magnet 8 having a recess in the air gap 6 and unto which the chassis B is attached. At 10 is the lower pole piece of the magnet 8 having holes 11 and 11A for concentration of the magnetic field in the air gap 6 as well as for holding the bobbing guide unit D. At 12 is the main frame of the system unto which is attached the flexible surround 13 and the gasket 14. At 13 as aforesaid is the flexible surround supporting the diaphragm A at its peripheral edge. At 15 are perforations on the bobbin 25 for atmospheric pressure equalization and coil's 7 cooling. At 16 is the plastic base unit of the bobbin guide D having an open upper end 20 and a pin-like lower end 19. The plastic base 16 being bonded to the inner face of the lower pole piece 10 and the hole 11A. At 17 is the outer skin member of the bobbin guide unit which makes instantaneous contacts with the bobbin 25 during excursions.At 18 is the resilient material of the bobbin guide D sandwiched between the outer skin member 17 and the plastic base 16 and bonded to both. At 21 is the subframe having an annular suspension plate 21A as well as openings 23 for atmospheric pressure equalization. At 22 is the bellows or damper whose upper section is attached to the lower layer 4 of the diaphragm A. The lower section of the bellows 22 is attached to the suspension plate 21A. At 24 is one of several mounting holes passing through the main frame 12 and the gasket 14. At 25 is the bobbin as earlier said, attached to the diaphragm layers 3 and 4 and the core 5.

Figure 2:
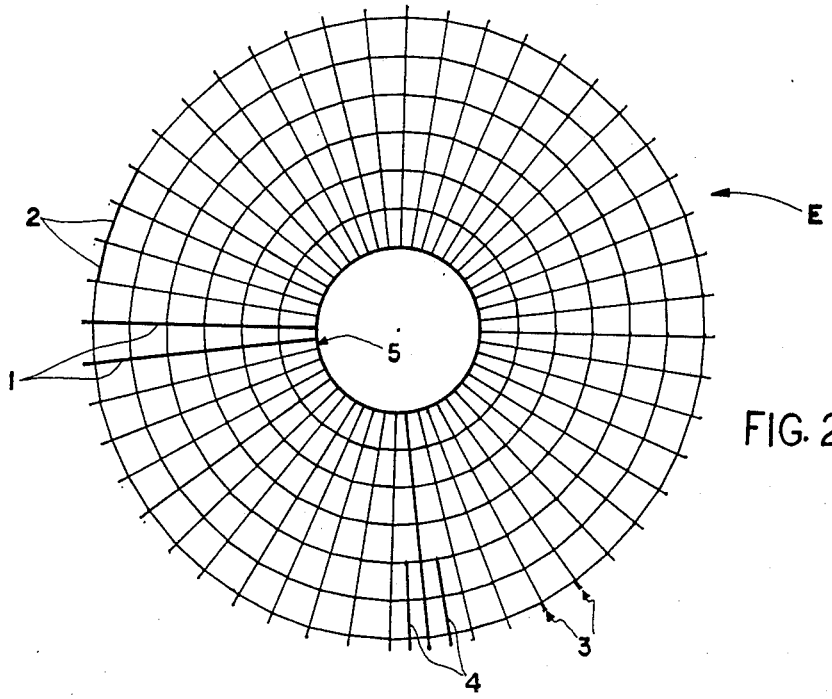
FIG. 2 is a aerial view of the inner core region of this present core configuration according to my teachings.

In reference to FIG. 2, (the outer core region E). At 1 is the lateral ribs originating from the central tubular rib 5. At 2 is the adjoining orbital ribs. Both lateral ribs have 1 and 2 adjoining orbital ribs equal distances between them respectively. At 4 are the lateral riblets used if desired to further strengthen the core at the outer perimeter regions. At 3 are the exposed trimmed edge portions of the core.

Figure 3:
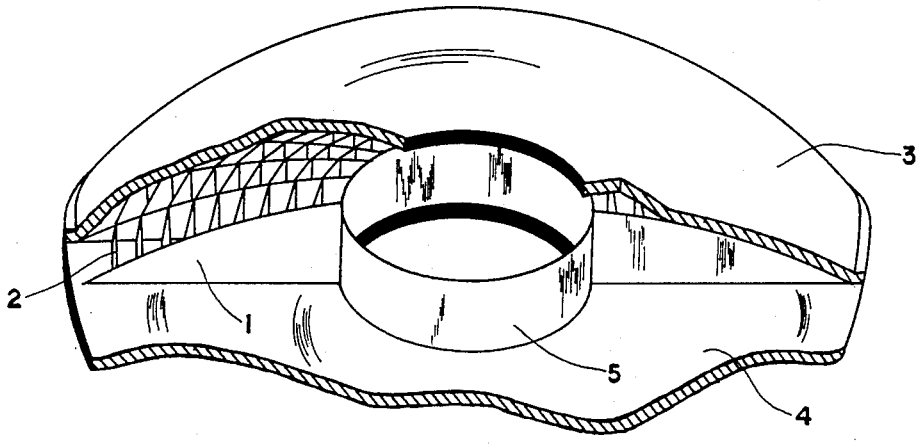
FIG. 3 is a cutaway diagram showing the core in FIG. 2 and the layers, arranged for a diaphragm.

Now referring to FIG. 3, A is the spider web core of aluminum foil (outer region). At 2 is an orbital rib, at 1 a lateral rib and at 5 a central tubular rib. At 3 and 4 are the upper and lower diaphragm layers respectively.

Figure 4:
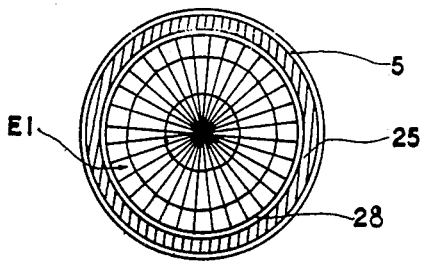
FIG. 4 is a top plan view of the bobbin and point of attachment to the core regions.
Figure 12A:
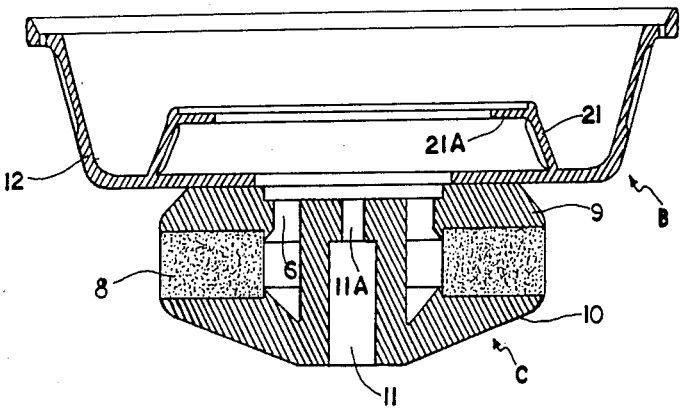
FIGS. 12*a* thru E are a set of steps used to center the moving parts of this present invention, excluding the inner diaphragm part.
Figure 12B:
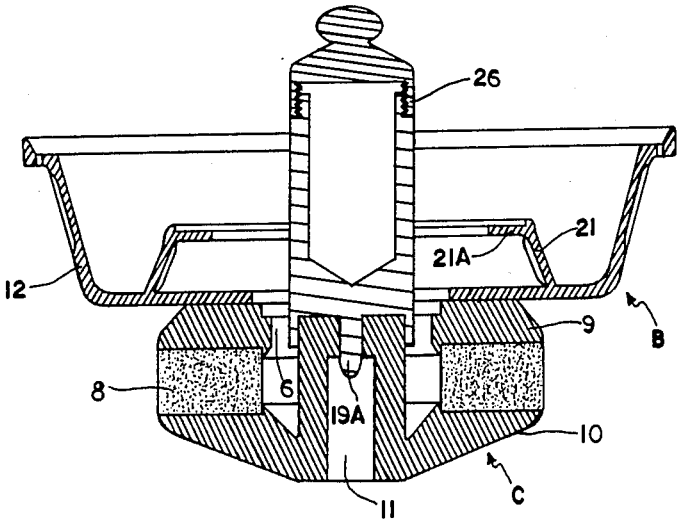
Figure 12C:
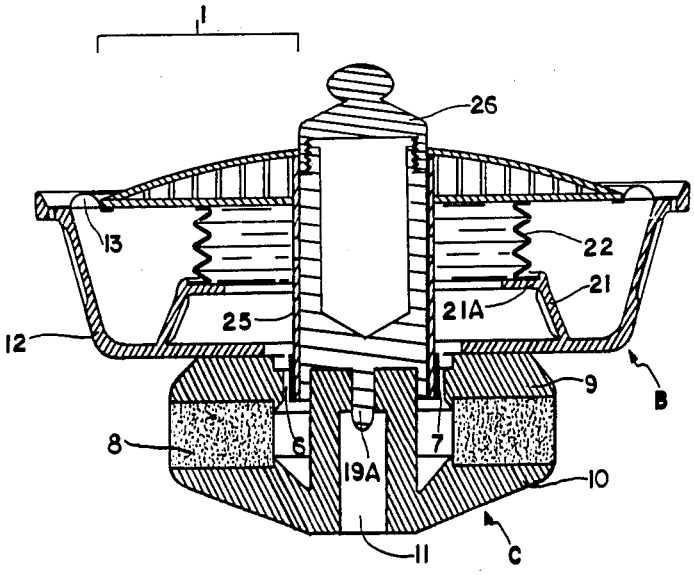
Figure 12D:
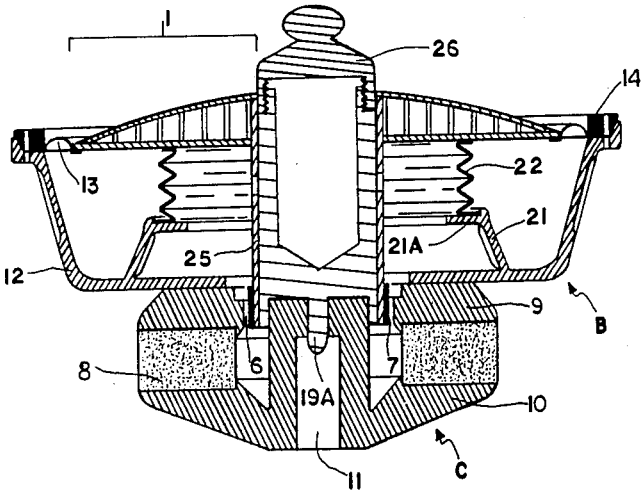
Figure 12E:
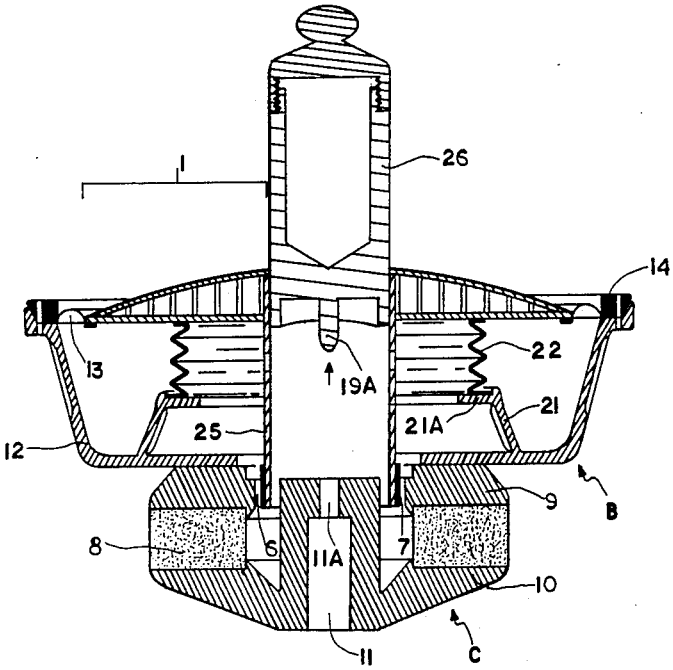

In FIG. 4, E1 is the core of the inner diaphragm part. At 5 is the central tubular rib. At 25 is the voice coil bobbin. AT 28 is the skin of the core E1. See also FIG. 16.

In FIG. 5 (inner diaphragm part. 2), E1 is the core having orbital ribs 2A and lateral ribs 1A and a core skin 28. At 3 and 4 are the upper and lower diaphragm layers having perforations $L_1$ and $L_2$ respectively.

Now referring to FIGS. 12A thru 12E.

Step I: The air gap 6 is obtained by placing securely, the upper and lower pole pieces 9 and 10 respectively atop and bellow the faces of the magnet 8 by means of a bonding agent to form the magnetic arrangement. Again, by means of a bonding agent, the chassis B is secured to the face of the upper pole piece 9 of the magnet 8 to complete the stationary unit.

Step II: A plastic holding jig 26 is positioned in the air gap 6 of the magnet 8. The pin-like end 19A, securely fitting into 11A of the lower pole piece 10.

Step III: The moving members (outer diaphragm part 1, bellows 22, bobbin 25, surround 13 and the voice coil 7) excluding the inner diaphragm part 2 and gasket 14 are set in place by passing the bobbin 25 through the jig 26 to correctly center the voice coil 7 in the air gap 6. The flexible surround 13 and the bellows 22 assume their natural positions and by means of a bonding agent are secured to 12 and 21A frame parts.

Step IV: The gasket 14 is now sandwiched between the frame 12 and the surround 13 and bonded thereat.

Step V: The holding jig 26 is now withdrawn from the bobbin 25. This step therefore completes the positioning of the coil 7 and bobbin 25 in the air gap 6.

Figure 13A:
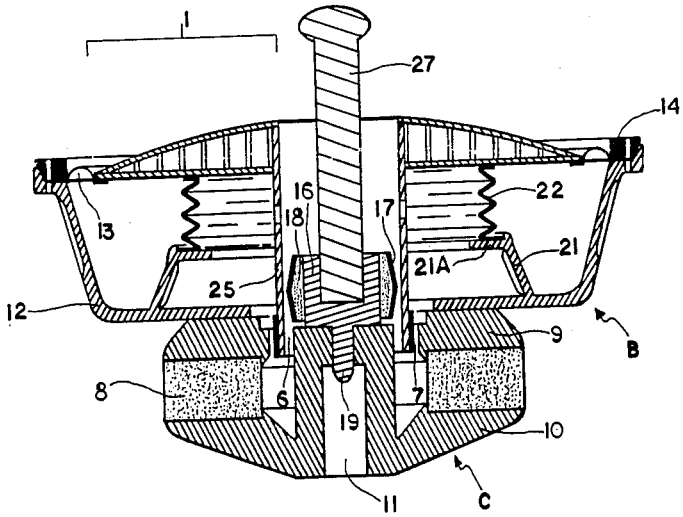
FIGS. 13A thru C are another set of steps used to position the bobbin guide unit (BGU) and including the inner diaphragm part of this invention.
Figure 13B:
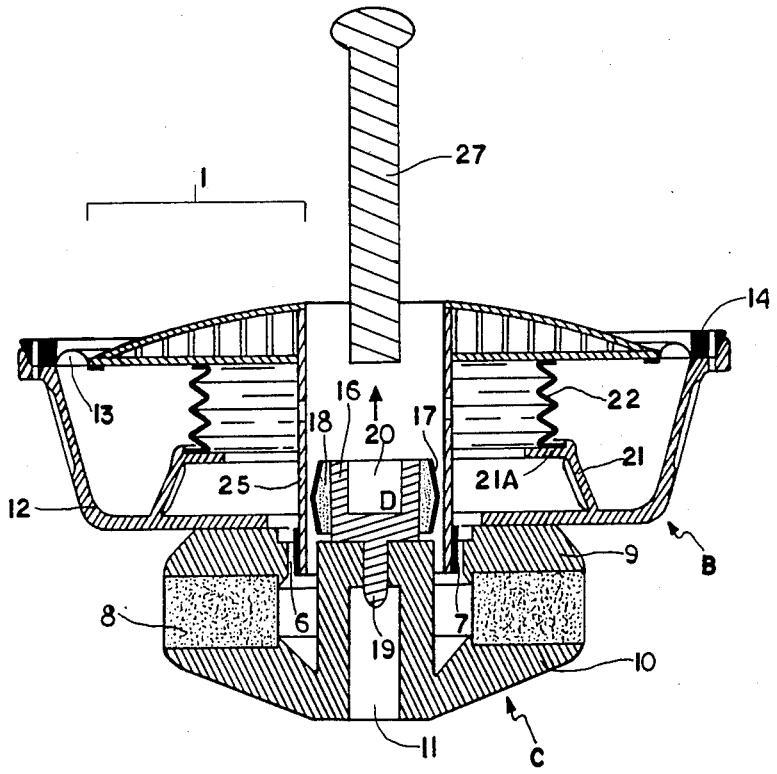
Figure 13C:
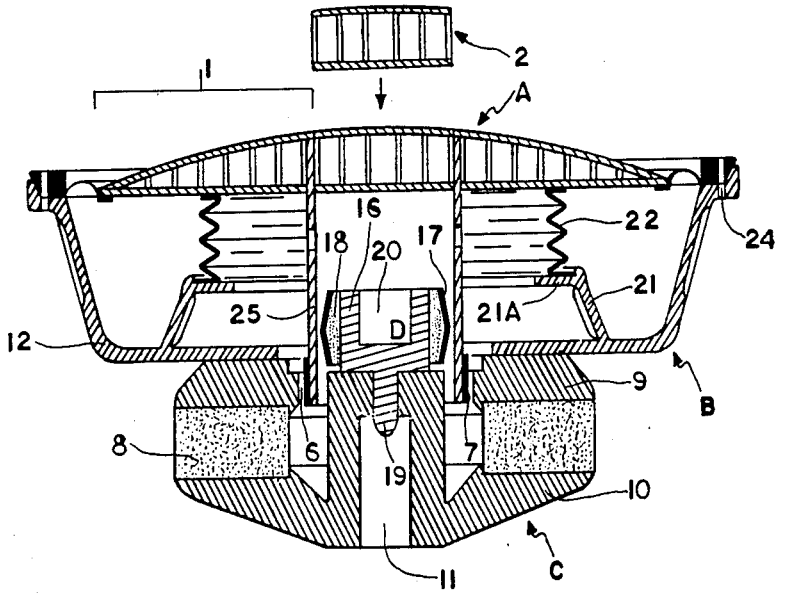

Now referring to FIGS. 13A thru 13C.

Step VI: A wooden push rod 27 is fitted into the open end 20 of the bobbin guide unit D. The unit is pushed through the bobbin 25 and securely bonded to the inner face of pole piece 1 by means of a bonding agent, with it's pin-like lower end 19 fitting into the hole 11A and protruding into 11.

Step VII: The wooden push rod 27 is now withdrawn from the bobbin guide unit D and consequently from the system to complete this process.

Step VIII: The inner diaphragm part 2 is now lowered into place and bonded to the upper part of the bobbin 25 and the upper diaphragm layer 3 to complete this present acoustic motor depicted in FIG. 1.

Figure 14:
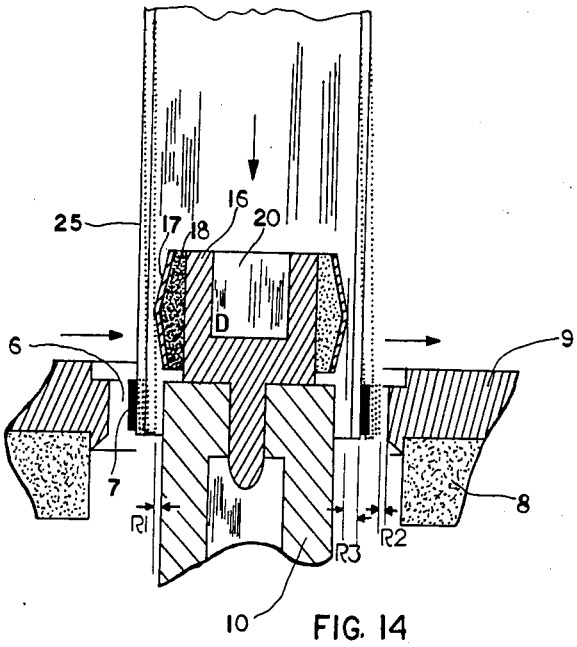
FIG. 14 is used to show how the bobbin guide unit prevents the bobbin from contacting the pole pieces during excursions.

In reference to FIG. 14, dotted lines represent the bobbin 25 on contacing the skin member 17 of the bobbin guide unit D. On contacting the skin member 17, clearances $R_1$ and $R_2$ are left between the bobbin and the pole pieces. Also, $R_3$ is left between the bobbin 25 and the skin member 17 on the opposite side of contact. At 8 is the magnet of the pole pieces 9 and 10. AT 6 and 7 are the air gap and voice coil respectively. 16 and 18 are the plastic base and resilient material respectively of the BGU. Arrows show the direction of bobbin movements.

Figure 15:
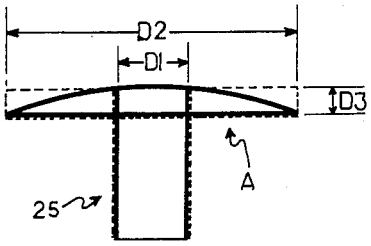
FIG. 15 is used to explain the relationship between this invention's diaphragm and that of a known planar type, vis-a-vis their weights and bonding strength resulting from design.

In reference to FIG. 15, the broken lines represent a diaphragm in accordance with the prior art. The solid lines represent the diaphragm in accordance with this invention of comparable size with the prior art to show the structural strength between the surfaces in relation to weight, arising from design. A is the diaphragm while 25 is the bobbin. $D_1$ is the bobbin diameter while $D_2$ is the diaphragm diameter. $D_3$ is the maximum core height.

Figure 16:
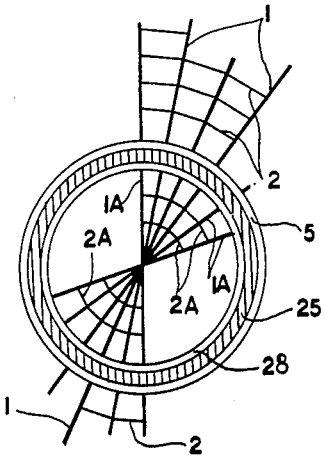
FIG. 16 is a top plan view showing the arrangement of the bobbin within the aligned core members of the outer and inner regions.

In reference to FIG. 16. 1 are the lateral ribs of the outer and inner core regions. At 2 and 2A are the adjoining orbital ribs of both the outer and inner regions respectively. At 5 is the central tubular rib. At 28 is the skin of the inner core. At 25 is the voice coil bobbin sandwiched between the tubular rib 5 and the core skin 28. See also FIG. 4.

Figure 17:
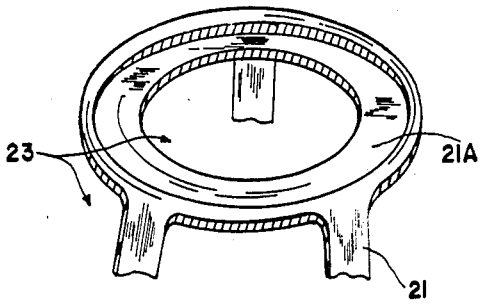
FIG. 17 is a view of the subframe of the present invention showing the parts.

In FIG. 17, 23 are the open ends, 21A the suspension plate and 21 the legs to form the subframe of the chassis B unto which the bellows 22 is attached.

Referring now to FIGS. 18A and B thru 21A and B

At 1 is the outer diaphragm part. AT 2 is the inner diaphragm part. At 3 is the upper diaphragm layer while at 4 is the lower layer. At 5 is the diaphragm core sandwiched between upper layer 3 and lower layer 4. At 7 is a voice coil attached to the bobbin 25. At 28 is an edging strip to eliminate unwanted vibrations at the peripheral edge trimmed portions of the core 5.

Figure 22A:
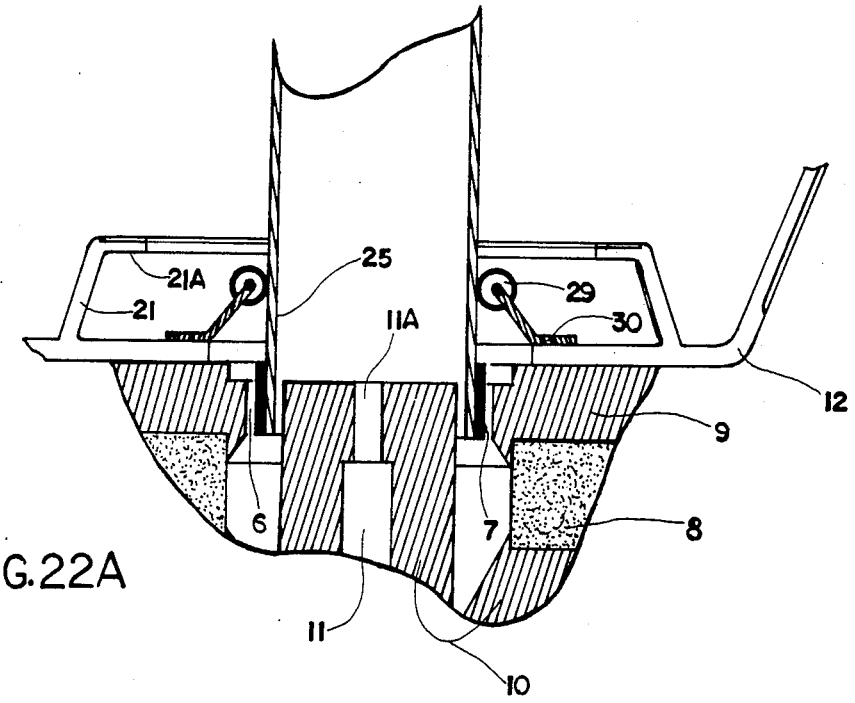
FIG. 22A is a cross-sectional view of the pinch rollers arranged to guide the bobbin.
Figure 22B:
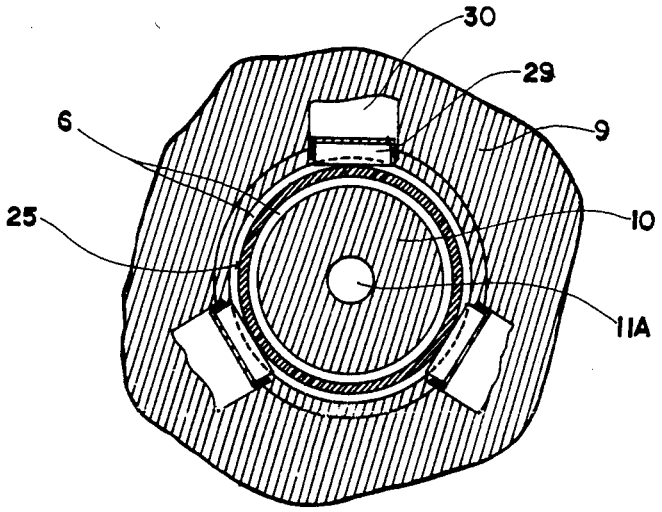
FIG. 22B is a top plan view of the same arrangement of 22A.
Figure 23A:
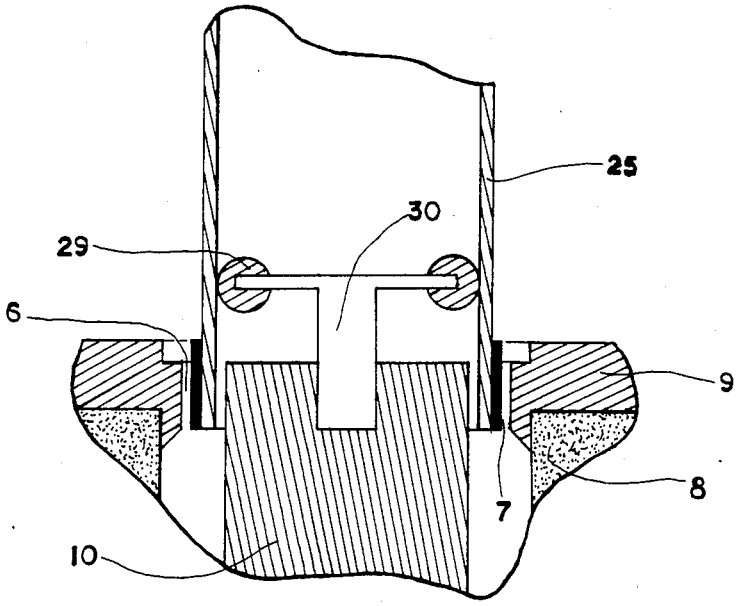
FIGS. 23A and B are cross-sectional and aerial views, respectively, of the ball rollers arranged to guide the bobbin.
Figure 23B:
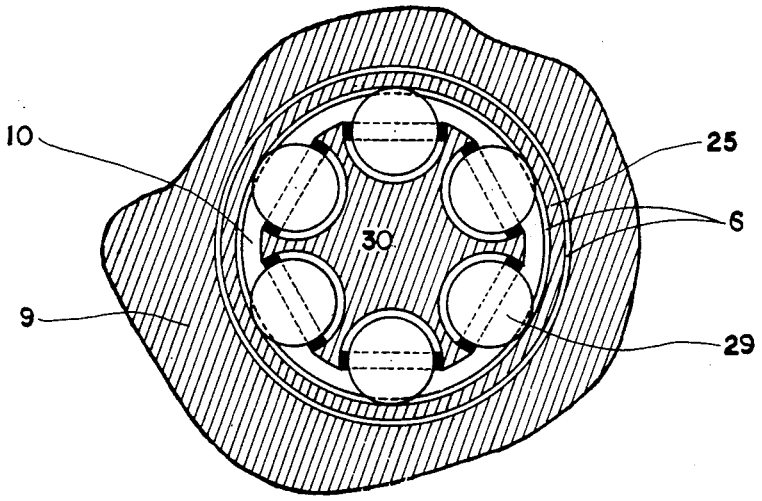

In reference to FIGS. 22A thru 23B, 6 is the annular air gap of the pole pieces 9 and 10. 25 is the bobbin in the air gap 6 and unto which the coil 7 is attached. 11 and 11A are the energy concentration holes on the pole piece 10. 30 are the supports of the rollers 29 bonded to the main frame 12 as in FIG. 22 or on the pole piece 10 as in FIG. 23.

With the detailed description of the embodiments completed, it is therefore emphasized at this point that an individual(s) skilled in the art could make reasonable changes without in any way deviating from the basic concepts applied in this invention.

I claim:

1. An acoustic device comprising:

a diaphragm having an upper layer and a lower layer;

a bobbin extending down through said lower layer and extending up to said upper layer;

a bellows having a lower end extruding downwardly from an attachment of said bellows to said lower layer of said diaphragm;

a frame having the lower end of said bellows attached thereto;

a flexible surround connected to said frame and said diaphragm;

a magnetic arrangement fastened to said frame provided with an upper pole piece and a lower pole piece;

a voice coil on said bobbin juxtaposed in relation to said upper pole piece;

said diaphragm including planar orbital ribs arranged about the center of the diaphragm in regular polygonal cross sections including concentrically disposed vertices on each polygonal cross section;

radially oriented lateral planar ribs intersecting said vertices;

said orbital ribs and said lateral ribs being situated completely between said upper layer and said lower layer of said diaphragm; and said bobbin being concentrically located an area void of said lateral ribs between two of said regular polygonal cross sections.

2. The acoustic device of claim 1 wherein:

said upper layer is entirely contoured as a dome; and said lower layer is contoured flat.

3. The acoustic device of claim 1 wherein:

said upper layer is contoured with a central dome with a flat rim on the periphery of said central dome; and said lower layer is contoured flat.

4. The acoustic device of claim 1 wherein:

said upper layer has a central concave portion with a flat rim at the periphery of the concave portion; and said lower layer is contoured flat.

5. The acoustic device of claim 1 wherein:

said upper layer has a flared portion outside said bobbin surrounded by a flat portion; and said lower layer has a frusto-conical portion surrounded by a flat portion.

6. The acoustic motor of claim 1 wherein:

said upper layer has a concave contour; and said lower layer is contoured flat.

* * * * *